US009784087B2

(12) United States Patent
Raglin

(10) Patent No.: US 9,784,087 B2
(45) **Date of Patent: *Oct. 10, 2017**

(54) DOWN-HOLE SAND AND SOLIDS SEPARATOR UTILIZED IN PRODUCING HYDROCARBONS

(71) Applicant: Spirit Global Energy Solutions, Inc., Midland, TX (US)

(72) Inventor: John M. Raglin, Midland, TX (US)

(73) Assignee: SPIRIT GLOBAL ENERGY SOLUTIONS, INC., Midland, TX (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/056,128

(22) Filed: Feb. 29, 2016

(65) Prior Publication Data

US 2016/0177696 A1 Jun. 23, 2016

Related U.S. Application Data

(63) Continuation of application No. 14/182,129, filed on Feb. 17, 2014, now Pat. No. 9,273,539, which is a continuation of application No. 13/195,402, filed on Aug. 1, 2011, now Pat. No. 8,651,184.

(51) Int. Cl.

| | |
|---|---|
| ***E21B 43/38*** | (2006.01) |
| ***E21B 43/02*** | (2006.01) |
| ***E21B 43/12*** | (2006.01) |
| ***E21B 43/08*** | (2006.01) |

(52) U.S. Cl.

CPC ..... *E21B 43/38* (2013.01); *E21B 43/02* (2013.01); *E21B 43/082* (2013.01); *E21B 43/121* (2013.01)

(58) Field of Classification Search

CPC ..... E21B 43/02; E21B 43/08; E21B 43/082; E21B 43/38

USPC ..... 166/265, 74, 105.1, 105.3, 105.4

See application file for complete search history.

(56) References Cited

U.S. PATENT DOCUMENTS

| | | | | |
|---|---|---|---|---|
| 6,382,317 B1 * | 5/2002 | Cobb | ..... | E21B 43/38 166/105.5 |
| 2010/0175869 A1 * | 7/2010 | Cobb | ..... | B04C 5/081 166/105.1 |

* cited by examiner

*Primary Examiner* — David Bagnell
*Assistant Examiner* — Michael Goodwin
(74) *Attorney, Agent, or Firm* — Russell T Manning; Marsh Fischmann & Breyfogle LLP

(57) ABSTRACT

A new method separating sand, solids, and produced particulates down-hole in a well producing hydrocarbons. The separation assembly can include ether one, two, or more segments or stages of varying lengths depending upon the individual application. The assembly is installed into the tubing string or delivery conduit of a well producing hydrocarbons. One stage can consist of a velocity chamber whereby separation of particulates occurs by increasing the downward velocity of particulates and reducing the upward velocity of hydrocarbons thereby allowing the particulates to "fall-out" into a lower chamber where the particulates are captured. Another stage can consist of a filter whereby particulates are captured in a chamber that can consist of filtering materials such as gravel, rock, sand, wood, or manmade materials. Each of the stages can be employed individually or in combination.

17 Claims, 3 Drawing Sheets

DOWN-HOLE SAND AND SOLIDS SEPARATOR UTILIZED IN PRODUCING HYDROCARBONS

CROSS REFERENCE TO RELATED DATA

This application is a continuation patent application of U.S. patent application Ser. No. 14/182,129, filed Feb. 17, 2014 (now U.S. Pat. No. 9,273,539), which is a continuation of U.S. patent application Ser. No. 13/195,402, filed Aug. 1, 2011 (now U.S. Pat. No. 8,651,184).

TECHNICAL FIELD

The present disclosure is directed to petroleum producing and injection wells and more particularly to the removal of particulates, such as sand, from the production stream.

BACKGROUND OF THE INVENTION

Petroleum wells can be naturally flowing, injecting or can be produced by any means of artificial lift. Particulates within the production stream, which can include both liquid and gaseous products, can be both naturally occurring and manmade. Such particulates can include sand, silt, and other solids and are a natural byproduct of the producing wells. As hydrocarbons and water flow through the formation, these particulates are carried in the flow stream and can be carried into the production tubing which can cause problems with the tubing or artificial lifting mechanism, such as a rod pump.

With an increase in fracturing of wells designed to increase the well's production, there has been an increase in fracture sand, the most common manmade particulate found at the wellhead. Fracture sand is commonly introduced into the reservoir in an effort to create conductive channels from the reservoir rock into the wellbore, thereby allowing the hydrocarbons a much easier flow path into the tubing and up to the surface of the well.

Natural or manmade particulates can cause a multitude of producing problems for oil and gas operators. For example, in flowing wells abrasive particulates can "wash through" metals in piping creating leaks and potentially hazardous conditions. Particulates can also fill-up and stop-up surface flow lines, vessels, and tanks. In reservoirs whereby some type of artificial lift is required such as rod pumping, electric submersible pumps, progressive cavity, and other methods, production of particulates can reduce of the life of the down-hole assembly and increase maintenance cost.

BRIEF SUMMARY OF THE INVENTION

An embodiment of a particulate separator for use with a petroleum production well producing a fluid mixture including particulate matter is described. The separator includes a velocity stage having an outer casing and an inner tube, the outer casing including intake slots allowing the fluid mixture to enter the space between the outer casing and inner tube and to flow downward toward a pump intake at a bottom end of the inner tube, wherein the fluid mixture reaches a downward velocity sufficient to allow the particulate matter in the fluid mixture to continue downward as the fluid is drawn into the inner tube through the pump intake, and a filter stage wherein the fluid mixture is drawn through a filter medium to filter the particulate matter from the fluid mixture.

In another embodiment a method for separating particulate matter from a fluid mixture for use with a petroleum production well producing is described. The method includes drawing the fluid mixture into a velocity stage having an outer casing and an inner tube, the outer casing including intake slots allowing the fluid mixture to enter the space between the outer casing and inner tube. The method further includes causing the fluid mixture to flow downward toward a pump intake at the bottom end of the inner tube, wherein the fluid mixture reaches a downward velocity sufficient to allow the particulate matter in the fluid mixture to continue downward as the fluid is drawn into the inner tube through the pump intake, and passing the fluid mixture through a filter stage wherein the fluid mixture is drawn through a filter medium to filter the particulate matter from the fluid mixture.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
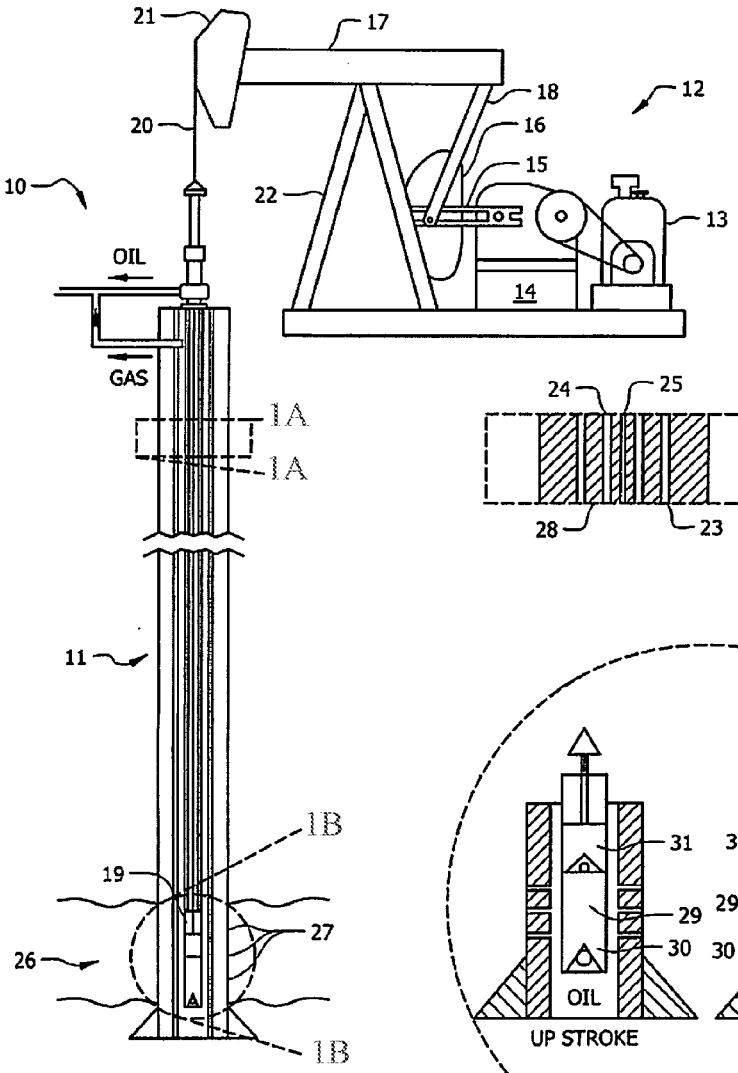
FIG. 1 is a diagram of a petroleum producing well.
Figure 1A:
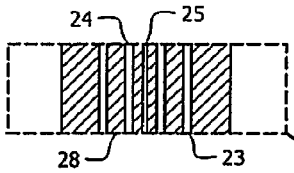
FIG. 1A shows a magnification of a portion of the producing well of FIG. 1.
Figure 1B:
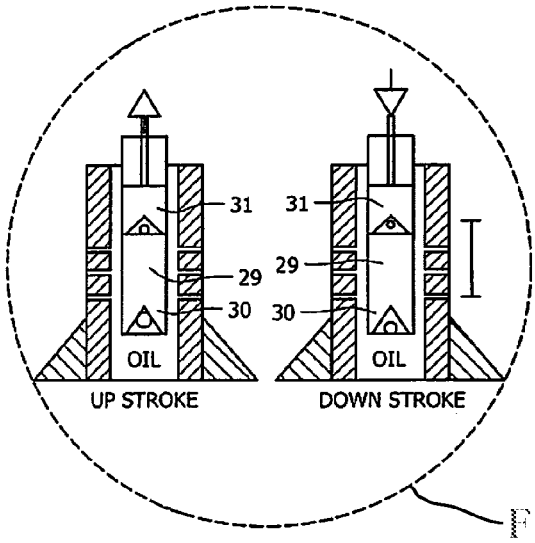
FIG. 1B shows a magnification of an existing sucker rod pump assembly of FIG. 1 to provide artificial lift.

Referring now to FIGS. 1, 1A and 1B, a diagram of a typical sucker rod pump used in oil wells is described. The sucker rod pump is described only for the purposes of illustrating the operation of a typical oil well and is not intended to be limiting in any manner as the present invention is applicable to any producing oil well including those using any means of artificial lift, such as rod pumping, electric submersible pumps, progressive cavity, and other methods.

Well 10 includes well bore 11 and pump assembly 12. Pump assembly 12 is formed by a motor 13 that supplies power to a gear box 14. Gear box 14 is operable to reduce the angular velocity produced by motor 13 and to increase the torque relative to the input of motor 13. The input of motor 13 is used to turn crank 15 and lift counter weight 16. As crank 15 is connected to walking beam 17 via pitman arm 18, walking beam 17 pivots and submerges plunger 19 in well bore 11 using bridle 20 connected to walking beam 18 by horse head 21. Walking beam 17 is supported by sampson post 22.

Well bore 11 includes casing 23 and tubing 24 extending inside casing 23. Sucker rod 25 extends through the interior of tubing 24 to plunger 19. At the bottom 25 of well bore 11 in oil bearing region 26, casing 23 includes perforations 27 that allow hydrocarbons and other material to enter annulus 28 between casing 23 and tubing 24. Gas is permitted to separate from the liquid products and travel up the annulus where it is captured. Liquid well products collect around pump barrel 29, which contains standing valve 30. Plunger 19 includes traveling valve 31. During the down stroke of the plunger, traveling valve is opened and product in the pump barrel is forced into the interior of tubing 24. When the pump begins its upstroke, traveling valve 31 is closed and the material in the tubing is formed forced up the tubing by the motion of plunger 19. Also during the upstroke, standing valve 30 is opened and material flows from the annulus in the oil bearing region and into the pump barrel.

As can be seen from FIG. 1, where the product flowing into the well bore contains sand and other particles, those particles can enter the pump and plug or cause damage to the pump mechanism, as well as the casing and tubing and above ground lines and tanks. Where there is sand and other particles mixed into the product, as can occur naturally or through fracking, it would be helpful to have a mechanism for separating the sand and particulates from the hydrocarbon product.

The present invention provides mechanisms for separating particulate matter from the well product. In preferred embodiments the mechanisms of the present invention consists of one or two individual stages for accomplishing the separation, which can work in tandem or be run as single assemblies.

Figure 2:
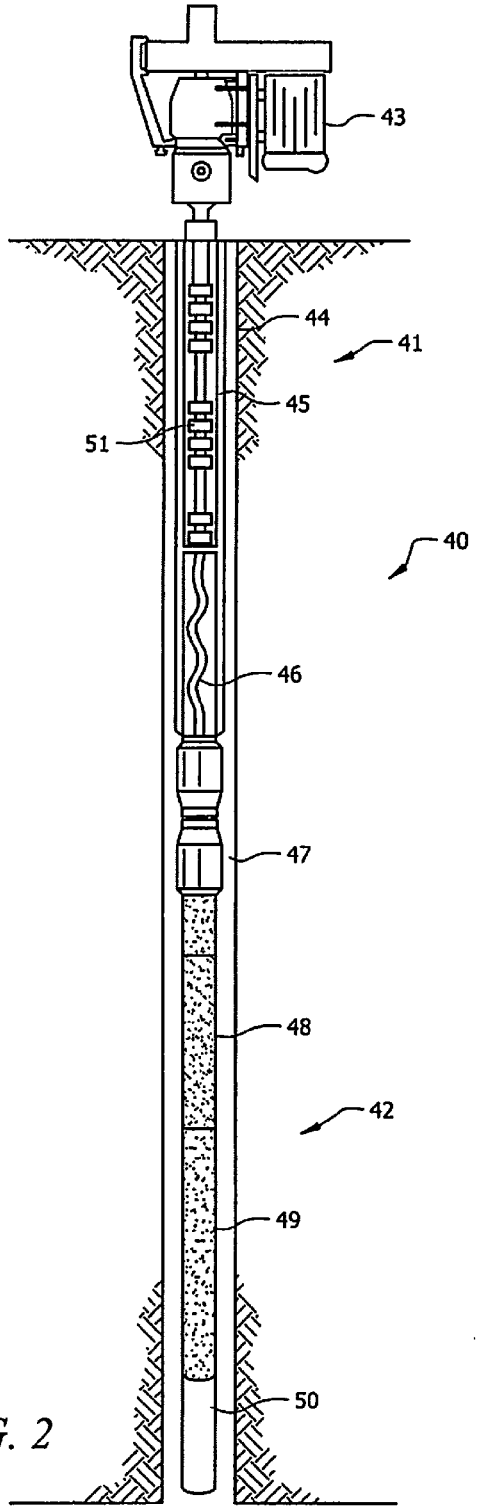
FIG. 2 is a diagram of a petroleum producing well showing utilizing a progressive cavity pump to provide artificial lift the well including an embodiment of a sand separator according to the concepts described herein.

Referring now to FIG. 2, an embodiment of a down-hole sand separator according to the concepts described herein is shown used in a production well incorporating a progressive cavity pump. Well 40 is formed by casing 44 and tubing 45 and includes pump section 41 and two stage sand separator 42. Pump section 41 includes motor 43 which drives shaft 51. Shaft 51 turns rotor and stator 46, which provides the lift for the well product entering well 40. Torque anchor 47 prevents motor 43 from turning tubing 45 within casing 44.

Sand separator stage 42 is preferably formed as a two stage separator having stage one 49 and stage two 48 which will be discussed in greater detail with reference to FIG. 3. Mud anchor 50 serves as a catch area for any foreign matter or solids removed from the production fluid. While a two stage sand separator is shown as a preferred embodiment, either stage could be used in alone or together in any combination within the well and still be within the scope of the concepts described herein.

Figure 3:
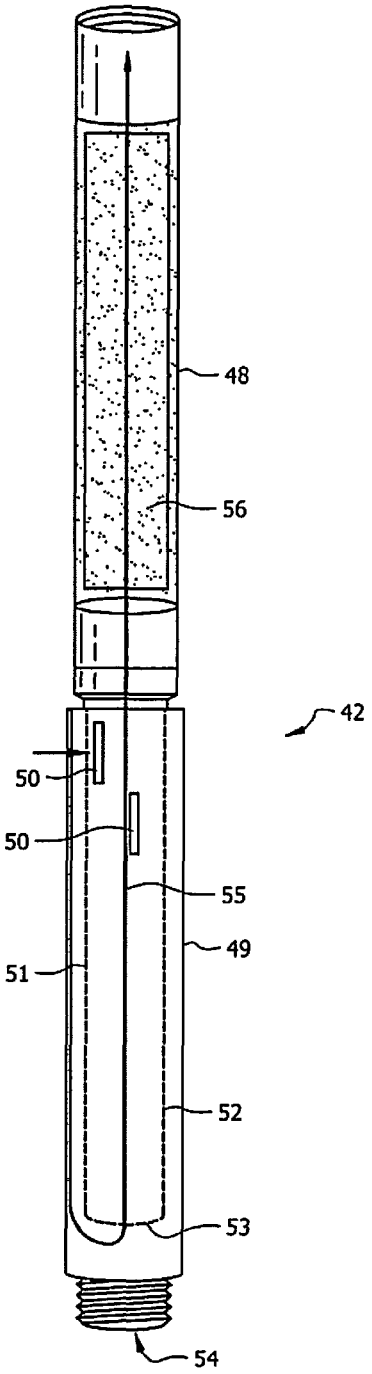
FIG. 3 is a diagram of the embodiment of a sand separator shown in FIG. 2 according to the concepts described herein.

Referring now to FIG. 3, a preferred embodiment of the sand separator 40 is described. Stage one 49 is known as the velocity stage. Production fluids enter velocity stage 49 through intake slots 57 in the outer casing 58 and proceed along flow path 51 down toward pump intake 53. Downward velocity of the production fluids increases as the mixture moves toward pump intake 53. Under chosen velocities, momentum of the heavier solid particulates in the fluid mixture are unable to reverse direction at pump intake 53 and continue into mud anchor 50, shown in FIG. 2, through outlet 54. By choosing the relative diameters of the outer casing 58 and inner tube 52 the downward velocity of flow path 51 and the upward, or suction velocity of flow path 55 can be controlled allowing the optimum velocity for the fluid mixture to be selected to reduce any vacuum effect at pump intake 53. Larger diameters for the inner tube 52 can designed to have a large relative diameter to reduce the intake velocity. A key to successful separation is to insure that the downward velocity of the gas, liquids, and particulates is greater than the upward intake velocity.

Through testing it has been determined that most particulates fall through liquid at a rate of 0.5 to 1.5 feet per second depending upon their mass and the viscosity of the liquid that the particulates are moving through. Once the liquid and gas now free of particulates have entered pump intake 53, the mixture is able to move into the inner tube and travel up to the surface of the well.

Stage two 48 is the filter stage. Filter stage 48 is a tubular casing that is preferably filled with some type of filtering material 56 that the produced gas, liquids, and particulates must pass through. As the matter flows along flow path 55 through the filter, particulates are captured in the filter media 56 and not allowed to continue to flow to the surface or to enter and damage other down-hole equipment. The filter media is held in the casing by retention screens at the input end and the output end of the casing The filter media can be any known filter media including such media as gravel, rock, sand, wood, plastic or other permeable substance suitable for the application.

As described above, either of the individual stages of the sand separator can be used independently of the other stage as a standalone sand separation device where the combined device is not practical or appropriate. For example, the filter stage 48 can be used as a standalone sand filter in horizontal wells where the velocity stage is not appropriate. Also, the dimensions of each stage, including the length, can be chosen for the particular application. While the sand separator of the present invention has been shown in conjunction with mechanisms to provide artificial lift, such as a sucker rod pump, a progressive cavity pump or submersible pump, the sand separator of the present invention can be used with a naturally flow well or a well with any other type of artificial lift mechanism.

Figure 4:
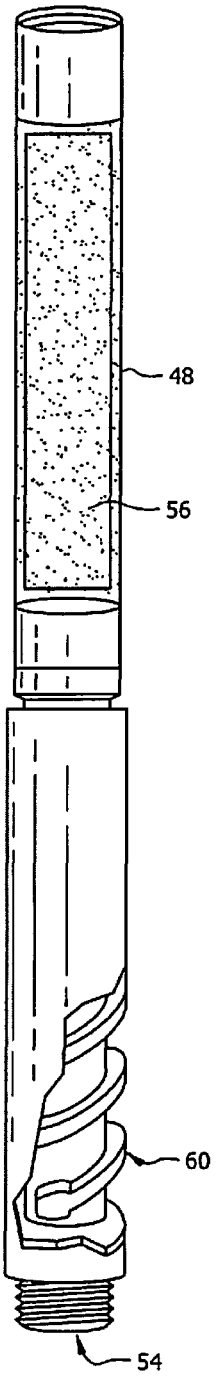
FIG. 4 is a diagram of an alternate embodiment of a velocity stage incorporating a vortex producing mechanism.

Referring now to FIG. 4, an alternate embodiment of the velocity stage of the separator according to the concepts described herein is shown. A continuous fin or a series of fins 60 are placed in the spacing between the outer casing and the inner tube. The fin 60 is preferably place in the lower section of the velocity stage and direct the fluid mixture radially downward. The radial flow of the fluid creates a vortex that is used to further aid in the removal of particular matter from the fluid mixture as the fluid in drawn up in to the pump input.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A particulate separator for use with a petroleum production well producing a fluid mixture including particulate matter, the petroleum production well including an artificial lift mechanism, the particulate separator comprising:

an inner tube having a lower inlet end and an upper outlet end with a sidewall there between, said upper outlet end being in fluid communication with the artificial lift mechanism;

an outer casing disposed about said inner tube, to define an annular space between an interior surface of said outer casing and an exterior surface of said inner tube, said outer casing having intake apertures extending through a sidewall of said outer casing allowing the fluid mixture to enter the particulate separator at a location above said lower inlet end of said inner tube; and wherein the fluid mixture flows downward in said annular space between the outer casing and inner tube toward said lower inlet end of said inner tube, the relative dimensions of the outer casing and the inner tube being chosen to achieve a downward velocity of the fluid mixture greater than an upward velocity at said lower inlet end of said inner tube, thereby causing the downward velocity to be sufficient to allow the particulate matter in the fluid mixture to continue downward as fluid of the fluid mixture is drawn into said lower inlet end of said inner tube.

2. The separator of claim 1 wherein a filter stage is positioned after the particulate separator.

3. The separator of claim 1 wherein a diameter of said inlet end is selected to minimize a suction velocity at said inlet end of said inner tube.

4. The separator of claim 1 wherein the artificial lift mechanism is a sucker rod pump.

5. The separator of claim 1 wherein the artificial lift mechanism is a submersible pump.

6. The separator of claim 1 wherein the artificial lift mechanism is a progressive cavity pump.

7. The separator of claim 1 wherein an upper end of said outer casing connects to said inner tube and a lower outlet end of said outer casing extends beyond said lower inlet end of said inner tube.

8. The separator of claim 7, further comprising:

a mud anchor attached to said lower outlet end of said outer casing, wherein the particulate matter continuing downward passes into said mud anchor.

9. The separator of claim 8, wherein all of the fluid mixture entering the particulate separator enters via said intake apertures in said outer casing.

10. The separator of claim 1, wherein an inlet area of said lower inlet end of said inner tube is greater than an area of said annular space thereby reducing the upward velocity of the fluid mixture relative to the downward velocity of the fluid mixture.

11. The separator of claim 1, further comprising:

at least one fin in said annular space between said outer casing and said inner tube, said at least one fin directing the fluid mixture into a radial downward flow.

12. A method for separating particulate matter from a fluid mixture for use with a petroleum production well, the method comprising:

drawing the fluid mixture into a particulate separator having an outer casing substantially surrounding an inner tube, the outer casing including intake apertures allowing the fluid mixture to enter an annular space between the outer casing and inner tube at a location above an opening in a lower end of the inner tube; and causing the fluid mixture to flow downward in the annular space toward the opening in the lower end of the inner tube, wherein the fluid mixture reaches a downward velocity while moving downward in the annular space that is greater than an upward velocity of the fluid mixture at the opening in the lower end of the inner tube, thereby causing the downward velocity to be sufficient to allow the particulate matter in the fluid mixture to continue downward as fluid of the fluid mixture is drawn into the inner tube through the opening.

13. The method of claim 12 wherein a filter stage is positioned after the particulate seperator.

14. The method of claim 12, further comprising:

drawing the fluid mixture into the particulate separator utilizing an artificial lift mechanism.

15. The method of claim 14 wherein the artificial lift mechanism is a sucker rod pump.

16. The method of claim 14 wherein the artificial lift mechanism is a submersible pump.

17. The method of claim 14 wherein the artificial lift mechanism is a progressive cavity pump.

* * * * *